US007156013B2

(12) United States Patent
Gibson et al.

(10) Patent No.: US 7,156,013 B2
(45) Date of Patent: Jan. 2, 2007

(54) HYDRAULIC CYLINDER COMPRISING VALVES

(75) Inventors: Cristopher Gibson, Gemlinden (DE); Katia Mild, Lohr (DE)

(73) Assignee: Bosch Rexroth AG, Stuttgart (DE)

( * ) Notice: Subject to any disclaimer, the term of this patent is extended or adjusted under 35 U.S.C. 154(b) by 0 days.

(21) Appl. No.: 10/488,412

(22) PCT Filed: Jul. 30, 2002

(86) PCT No.: PCT/DE02/02804

§ 371 (c)(1),
(2), (4) Date: Aug. 9, 2004

(87) PCT Pub. No.: WO03/027507

PCT Pub. Date: Apr. 3, 2003

(65) Prior Publication Data

US 2004/0250675 A1 Dec. 16, 2004

(30) Foreign Application Priority Data

Aug. 29, 2001 (DE) ..... 101 41 766
Oct. 24, 2001 (DE) ..... 101 52 414

(51) Int. Cl.
*F15B 11/08* (2006.01)

(52) U.S. Cl. ..... 91/450

(58) Field of Classification Search ..... 91/394, 91/408, 450
See application file for complete search history.

(56) References Cited

U.S. PATENT DOCUMENTS 2,842,284 A * 7/1958 Flick ..... 91/394
2,973,744 A * 3/1961 Hennells ..... 91/394
4,475,710 A * 10/1984 Leupers ..... 91/450

FOREIGN PATENT DOCUMENTS

DE 30 19 119 A1 11/1981
DE 692 12 197 T2 3/1997
EP 0 970 803 A1 1/2000
GB 2 104 961 3/1983

OTHER PUBLICATIONS

Rexroth Hydraulics, Gibson, "All from one source. Hydraulic closed loop control systems for gas and steam turbines", date unknown, all pages.

* cited by examiner

*Primary Examiner*—F. Daniel Lopez
(74) *Attorney, Agent, or Firm*—Boyle Fredrickson Newholm Stein & Gratz S.C.

(57) ABSTRACT

An energy cylinder for operating a valve of a turbine, in particular of a steam turbine, is disclosed, wherein a cylinder housing and a control block are combined into a common block. The latter has two diametrically arranged lateral surfaces on which a control valve and a logic valve for controlling the pressure medium flows are arranged.

13 Claims, 3 Drawing Sheets

HYDRAULIC CYLINDER COMPRISING VALVES

BACKGROUND OF THE INVENTION

1. Field of the Invention

The invention concerns a hydraulic cylinder for operating a valve of a steam turbine or the like.

2. Description of the Related Art

Hydraulic regulating means have a long tradition in gas and steam turbine construction. Concurrently with the advance of power plant technology, more and more so-called "G&S" (gas-and-steam) plants are being built in a combination process. With the aid of the hot exhaust gas of the gas turbine via a waste heat boiler, this process generates water vapor which is resupplied to the power generation process via the downstream steam turbine. Such plants have an efficiency of up to 60%. In order to master the turbines in terms of control and safety technology, a multiplicity of regulating valves and switching valves are necessary. For actuation of these valves, hydraulic cylinders generally having the form of a servo cylinder are increasingly being used. Driving the energy cylinder is achieved via an attached control block which includes a regulating valve for driving the cylinder and a quick-action stop valve through which the pressure medium may be relieved toward the tank within a minimum time period (100–200 ms) in a pressure chamber of the cylinder acting in the opening direction, so that the valve is closed by the force of a disk spring assembly.

In solutions as known, e.g., from the information brochure RE 09900/08.97 *"Alles aus einer Hand-Hydraulische Regelungssysteme an Gas-und Dampfturbinen, Mannesmann Rexroth GmbH"*, the quick-action stop valve and the regulating valve are arranged in a control block installed on the cylinder. In this control block all the passages for pressure medium supply and discharge are formed, so that separate conduits need not be provided in practice.

It is a problem in the formerly employed hydraulic cylinders that under particular operating conditions, vibrations in the range of the hydraulic cylinder may occur which may have a negative effect on proper operation of the associated regulating or switching valve and thus on the operation of the turbine.

SUMMARY OF THE PRESENT INVENTION

In view of this, the invention is based on the object of furnishing a hydraulic cylinder for operating a valve of a turbine wherein operating safety is improved at minimum expenditure in terms of device technology.

This objective is achieved through a hydraulic cylinder for operating a valve of a turbine having the claimed features.

In accordance with the invention, the hydraulic cylinder comprises a cylinder housing integrated into a common block with the control block accommodating the control valve and the quick-action stop valve, which control block has two diametrically arranged end faces on which the control valve and the switching valve, respectively, is attached.

Such an assembly is characterized by an extremely compact structure in which, owing to the arrangement of the control valves on opposite end face portions of the block a symmetrical arrangement is made possible, whereby generation of vibrations during operation of the hydraulic cylinder may be reduced considerably in comparison with the conventional solutions involving eccentrically arranged valves. On the remaining end faces of the block it is then possible to arrange further control elements such as, e.g., the electronic control unit, measurement systems etc., whose weight as a general rule is smaller than that of these valves.

The hydraulic cylinder has a particularly compact design and may be manufactured with particular ease if the block constituting the cylinder and the control block has a parallelepipedic shape, with the quick-action stop valve and the control valve being secured to opposite lateral surfaces. Manufacture of the block is particularly simple if the cylinder housing and the control block have a common, essentially monobloc housing. The unbalanced mass is minimum if the piston axis is situated approximately in the plane of symmetry of the two diametrically arranged end faces.

In a particularly preferred variant, the hydraulic cylinder is designed as a double rod cylinder having a double piston rod, with the oil volumes in both pressure chambers being identical.

A rear-side piston rod of the hydraulic cylinder is in this case designed to project from the block and may cooperate with a path measurement system for adaptation of the piston stroke.

Passage design in the block is particularly simple if a passage portion connected with a work port of the control valve opens into an annular passage encircling a bush guiding a piston rod, into which annular passage in turn a passage opens which connects the inlet port of the quick-action stop valve with the pressure chamber. Preferably the annular passage is designed as an annular groove in the bush. Upon insertion of the bush, the annular passage is then formed with the reception bore.

The piston rod velocity is determined by a meter-out orifice arranged in the meter-out passage.

It is particularly advantageous if the hydraulic cylinder has a damping chamber communicating with the meter-out passage via a damping orifice. This damping orifice is arranged in parallel with the orifice of the meter-out passage and serves for braking the piston rod prior to impact.

In a preferred embodiment the quick-action stop valve is designed as a logic valve, while the directional control valve is a servo valve.

Other advantageous developments of the invention are the subject matters of the further subclaims.

BRIEF DESCRIPTION OF THE DRAWINGS

In the following a preferred embodiment of the invention is explained in more detail by referring to schematic drawings, wherein.

DETAILED DESCRIPTION OF THE PREFERRED EMBODIMENTS

Figure 1:
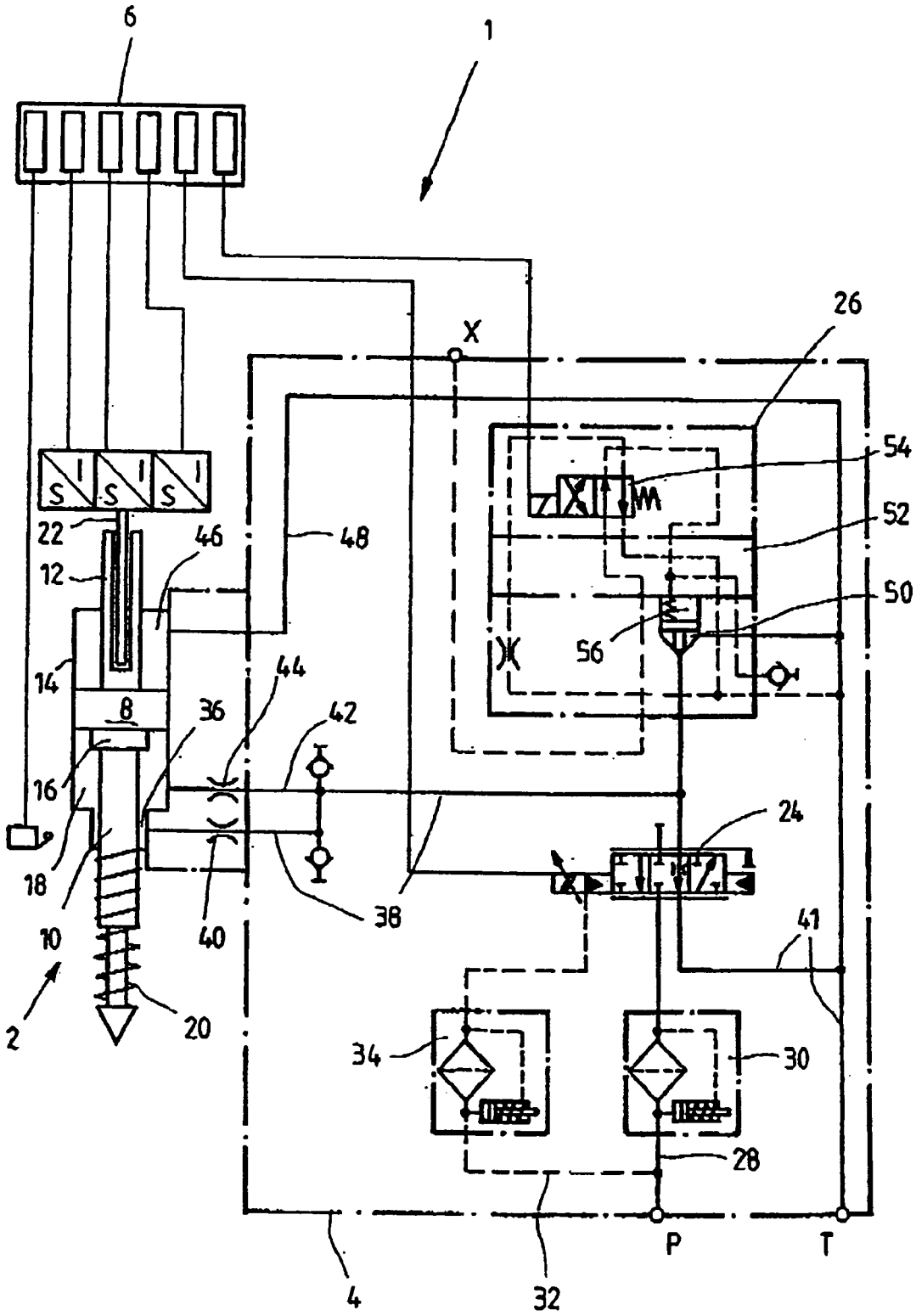
FIG. 1 is a switching diagram for a hydraulic cylinder in accordance with the invention for operating a valve of a steam turbine, wherein the piston rod is extended by spring force and retracted hydraulically.

In FIG. 1 the hydraulic switching diagram of a so-called "energy cylinder" for actuation of a switching or regulating valve of a steam turbine is represented. The energy cylinder 1 essentially consists of a hydraulic cylinder 2 and a control block 4 associated thereto and including a control unit 6.

The hydraulic cylinder 2 is designed as a double rod cylinder and includes a piston 8 with a valve-side piston rod 10 and a rear-side piston rod 12. The piston 8 is guided in a cylinder housing 14. The end face of the piston 8 facing the valve-side piston rod 10 has a stepped design, with a radially set-back damping projection 16 plunging into a correspondingly shaped portion of a pressure chamber 36 of the cylinder 14 during an axial displacement of the piston 8. When the damping projection 16 plunged into this radially set-back portion, an annular damping chamber 18 is formed from which the pressure medium may flow off via the damping orifice only.

As is indicated in FIG. 1, the piston 8 is biased into a home position by a strong spring, e.g., a disk spring assembly 20. In the case of energy cylinders 1, the piston 8 is usually biased by the disk spring assembly 20 into its closed position—i.e., in the representation of FIG. 1 in a downward direction—wherein the valve element to be actuated with the aid of the hydraulic cylinder 2 is pressed against its valve seat.

The end portion of the rear-side piston rod 12 is designed to project from the cylinder housing 14 and cooperates with a path measurement system 22 whereby the piston position and/or piston velocity may be detected. The signals detected by the path measurement system 22 are processed in the control unit 6.

The control block 4 represented in FIG. 1 has a pressure port P, a tank port T, as well as at least one control port X, and essentially consists of a control valve 24 and a quick-action stop valve 26, the latter having the form of a piloted logic valve (2/2-cartridge valve) 26 in the represented embodiment.

In the represented embodiment the control valve 24 is designed as a servo valve with 4 ports, wherein, however, a control land is not ground, so that the port designated as A is blocked in any control position of the control valve 24. A port P of the control valve 24 is connected to the pressure port P via a pressure passage 28 and a filter 30. The filter 30 is in a conventional manner provided with a differential pressure measurement device whereby a blockage may be displayed.

The pressure applied at the pressure port P is conducted via a control passage 32 and an additional filter 34 to a control surface of the control valve 24. Electrical driving of the control valve 24 is achieved through the control unit 6. The pressure chamber 36 of the cylinder 14 is connected with a work port B of the control valve 24 via a passage 38, while a tank port T of the control valve 24 is connected with the tank port T via a tank passage 41.

In the represented home position of the control valve 24 port P is blocked, while ports B and T are communicated via an orifice, so that pressure medium may flow from the pressure chamber 36 towards the tank T.

In passage 38 a meter-out orifice 40 is provided whereby the velocity of the pressure medium flow between the control valve 24 and the pressure chamber 36 is determined. From the passage 38 a damping passage 42 branches off which opens into the damping chamber 18 and has a damping orifice 44 provided therein. This damping orifice 44 determines the velocity of the pressure medium displaced from the damping chamber 18 or flowing into the latter.

Through suitable driving with the aid of the control unit 6 the valve element of the control valve 24 may be shifted to the left in the representation in accordance with FIG. 1, so that the connection between the pressure port P and the work port B is opened, and pressure medium may flow into the pressure chamber 36 via passage 38 and meter-out orifice 40—the piston 8 is in this case displaced against the force of the disk spring assembly 20, so that the associated switching or regulating valve of the steam turbine is taken into an open position. The pressure medium displaced from a rear-side pressure chamber 46 is displaced via a return passage 48 and the tank passage 41 to a tank connected to the tank port T. In the represented embodiment, the connection of the rear-side pressure chamber 46 towards the tank is constantly open.

When the control valve 24 is driven in the opposite direction (to the right in FIG. 1), the connection between the work port B and the tank port T is controlled open, and the pressure port P is blocked, so that pressure medium may flow off from the pressure chamber 36 towards the tank T—the actuated switching or regulating valve is moved back in the direction towards its closed position.

For the case that this valve—e.g. in the event of a malfunction of the steam turbine—has to be closed very rapidly, the velocity of this closing operation is determined by the time during which the pressure medium flows off from the pressure chamber 36 towards the tank T. As the control valve 24 is not designed for this emergency function and its response characteristics accordingly are too sluggish, the logic valve 26 is provided for this emergency function, whereby the pressure medium may flow off from the pressure chamber 36 to the tank T within an extremely short period, so that the valve may be taken into its closed position by the effect of the disk spring assembly 20.

In the represented embodiment the logic valve 26 includes a 2-way directional seat valve 50 closed upwardly (FIG. 1) by a control plate 52. A pilot valve 54 is seated on the control plate 52. The inlet port A of the seat valve 50 is connected to the passage 38 communicating with the pressure chamber 36, while an outlet port B is connected to the return passage 48.

In its normal operation position the pilot valve 54 is in its spring-biased home position wherein a spring chamber 56 of the seat valve 50 receives the control pressure prevailing at the control port X, which control pressure is selected to be so high that the seat valve 50 is biased into its closed position. In the event of a malfunction, the pilot valve 54 is switched by the control unit 6, so that the spring chamber 56 is relieved of pressure. The seat valve 50 is then opened by the pressure in the passage 38, and the pressure medium may flow off from the pressure chamber 36 to the pressure chamber 46 while bypassing the control valve 24—the valve operated by the hydraulic cylinder 2 is taken into its closed position by the force of the disk spring assembly 20.

Figure 2:
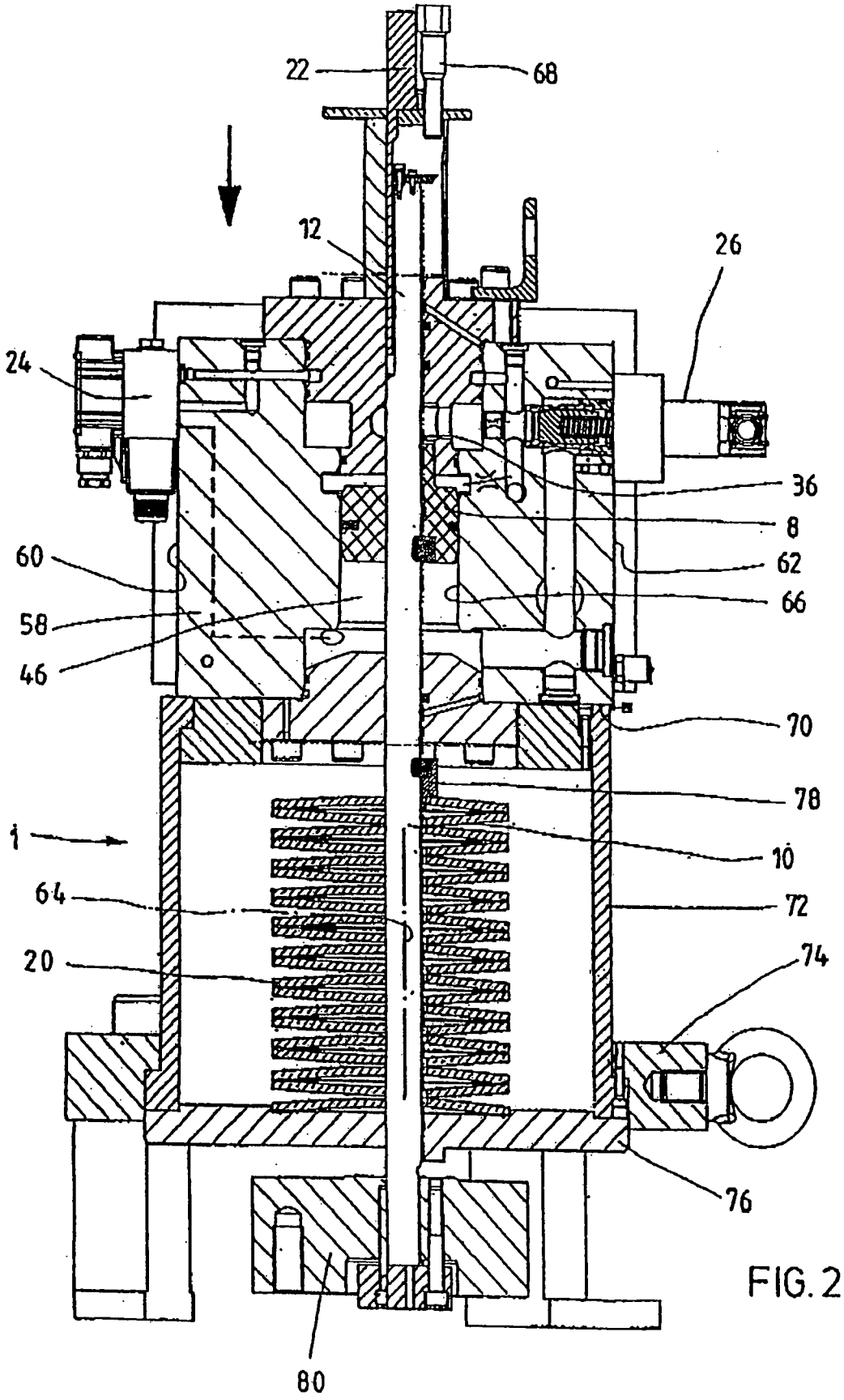
FIG. 2 is a sectional view of a hydraulic cylinder similar to FIG. 1 with the piston rod, however, being retracted by spring force and extended hydraulically.

FIG. 2 shows a sectional view of an embodiment of an energy cylinder 1 wherein the afore-described components are combined. In the shown embodiment, the plane of section does not extend in parallel with the plane of drawing, but in the lower half has an inclination relative to the plane of drawing.

In the embodiment of the invention represented in FIG. 2, the control block 4 and the cylinder 14 of FIG. 1 are combined into a common block 58 having an approximately parallelepipedic shape. This block has two diametrical lateral surfaces 60, 62 extending at a right angle with the plane of drawing in FIG. 2, on which the control valve 24 having the form of a servo valve and the logic valve 26, respectively, are attached. As may be seen in the representation in accordance with FIG. 2, the two lateral surfaces 60, 62 are equidistant from the piston axis indicated in dash-dotted line in FIG. 2 and representing in the representation in accordance with FIG. 2 an axis of symmetry for the two lateral surfaces 60, 62.

Due to this measure, the valves 24 and 26, which have a comparatively high weight, are positioned approximately at a same distance from the piston axis 64, so that the effective point of gravity of these two valves 24, 26 is situated approximately in the rage of the piston axis 64.

In the block 58 a cylinder bore 66 is formed wherein the piston 8 with the two piston rods 10, 12 is guided so as to be axially displaceable. As a result of the piston 8, the cylinder bore 66 is subdivided into the rear-side pressure chamber 46, the damping chamber 18, and the pressure chamber 36. The end portion of the rear-side piston rod 12 is designed to project from the block 58 and cooperates with the path measurement system 22 and with a limit switch 68.

At the lower face of the block 58 in FIG. 2 a spring housing 72 is flange-connected, an the bottom 76 of which the disk spring assembly 20 is supported. The latter attacks at a drive member 78 of the piston rod 10, so that the piston 8 is biased upwardly in the representation in accordance with FIG. 2. At an end portion of the piston rod 10 extending through the bottom 76 of the spring housing 72, an adapter 80 is arranged which is capable of being connected with the valve element of the associated valve.

For mounting the energy cylinder 1, a mounting flange 74 is arranged at the outer periphery of the spring housing 72.

Figure 3:
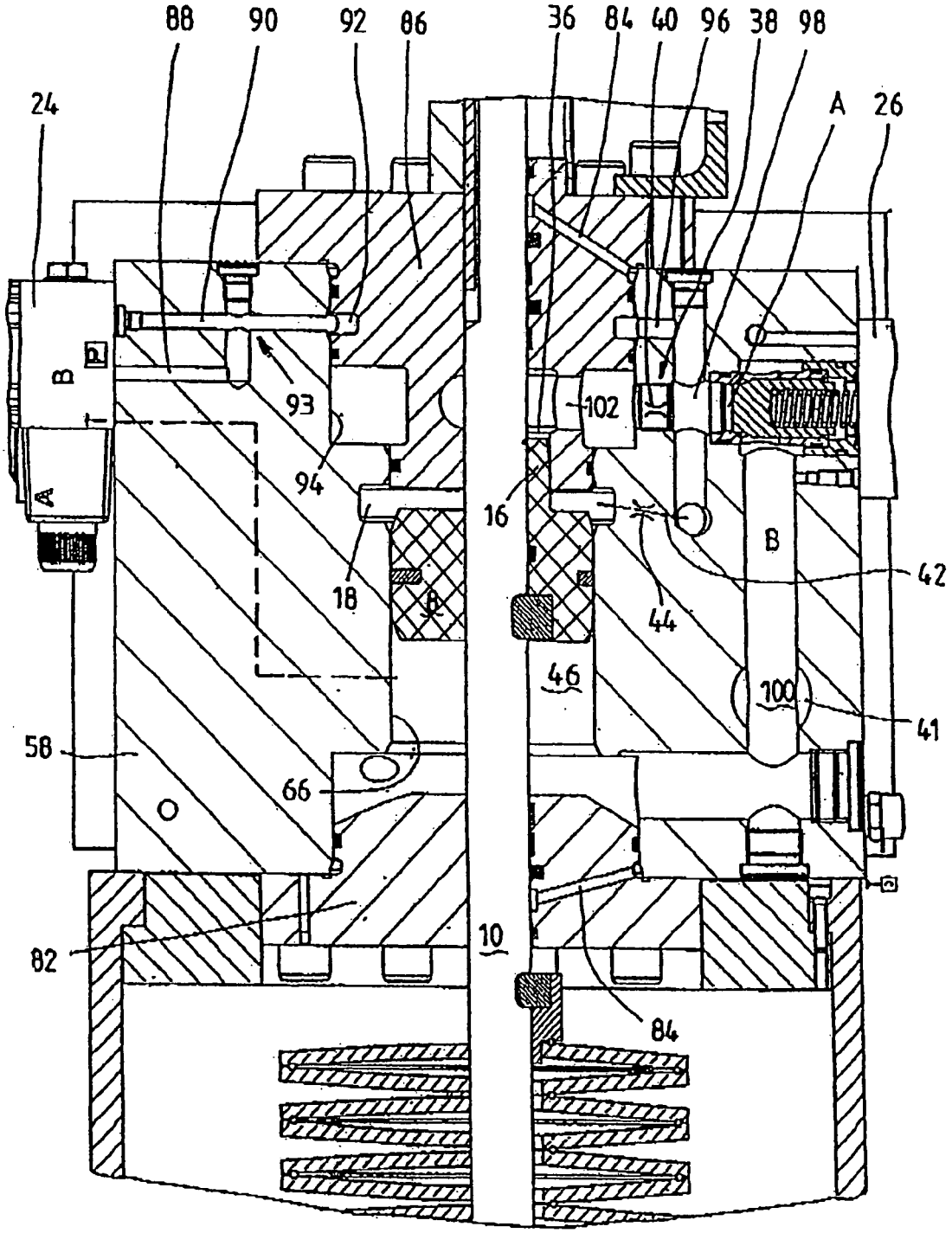
FIG. 3 shows a detail of the hydraulic cylinder of FIG. 2.

Further details of the block structure are explained by referring to FIG. 3. Accordingly, the lower portion of the cylinder bore 66 in the representation of FIG. 3 is blocked by a front plate 82 through which the piston rod 10 extends. In this front plate a leakage bore 84 is provided, through which a leakage produced along the outer peripheral surface of the piston rod 10 may be drained to the outside. The upper portion of the cylinder bore 66 in the representation of FIG. 3 is closed by a bush 86 equally provided with a leakage bore 84 for draining of a leakage.

The work port B of the control valve 24, indicated in FIG. 3, is connected with an annular groove 92 at the outer periphery of the bush 86. In the represented embodiment this is achieved through an angular bore 88 and a bore 90 intersecting it, both of which are closed on one side. The annular groove 92 and the neighboring outer peripheral surface of a reception bore 94 for the bush 86 define an annular passage into which a connection passage 96 opens. This connection passage 96 also has an angular configuration in the represented embodiment and constitutes a connection between the above-described annular passage (annular groove 92) ad a passage section 98 wherein the meter-in orifice 40 is arranged. The angular connection passage 96 communicates with the damping chamber 18 via the damping passage 42 and the damping orifice 44. The passage 38 represented in FIG. 1 is thus, in the concrete solution in accordance with FIG. 3, practically formed by the angular bore 88, the bore 90, the annular groove 92, the connection passage 96, and the passage section 98. The outlet port B of the logic valve 26 is connected to the tank passage 41 via a tank line 100.

In accordance with FIG. 3, the passage section 98 opens into a radial bore 102 of the bush 86 through which a connection with the cylinder bore 66 is established.

As was already described at the outset, the damping projection 16 of the piston 8 plunges into the guide bush 86. In the home position represented in FIG. 3, the piston 8 is in the range of its upper (view of FIG. 3) end position in which the associated valve is closed. In order to open the valve, the control valve 24 is switched so that pressure medium flows via the work port B, the angular bore 88, the bore 90, the annular passage 92, the connection passage 96, the passage section 98, the meter-in orifice 40 and also via the parallel damping passage 42 with the damping throttle 44 into the pressure chamber 36 or the damping chamber 18, respectively. The rear-side pressure chamber 46 is permanently connected with the tank passage 41, so that the piston 8 is displaced downwardly (view of FIG. 3) against the force of the disk spring assembly 20, and the valve is taken into its open position. Following a predetermined axial displacement of the piston 8, the damping projection 16 moves out from the radially set-back portion of the cylinder bore 66, with the damping orifice 44 accordingly ceasing to have an effect. As was already described, the control valve is controlled for closing the valve of the steam turbine in such a way that the pressure chamber 36 may drain towards the tank via the radial bore 102, the meter-out orifice 40, the passage section 98, the connection passage 96, the annular groove 92, the bore 90, the angular bore 88, and via the tank port T of the control valve 24 communicating with the angular bore 88.

In an emergency the logic valve 26 is opened, so that the pressure medium may directly flow off to the tank passage 41 via the radial bore 102, the meter-in orifice 40, the passage section 98, the opened logic valve 26 and the line 100.

As may moreover be learned from FIGS. 2 and 3, the control unit 6 is attached on the rear-side lateral surface of the block 58 extending in parallel underneath the plane of drawing. At the lateral surface located above the plane of drawing, additional elements of the energy cylinder 1 may moreover be attached, such as measurement sensors etc., which do, however, have a substantially lower weight than the valves 24, 26.

Instead of the control valve 24 designed as a servo valve it is also possible in comparatively simple applications to employ a simple switching valve, e.g., a 3/3-directional control valve.

What is essential in the invention is that the cylinder housing and the control block are combined into a common (one-part or multi-part) compact housing which has at least two diametrical lateral surfaces 60, 62 arranged substantially in symmetry with the piston axis 64, to which lateral surfaces heavy components such as, e.g., the control valve 24 and the logic valve 26 are secured, whereby a centered position of the center of gravity of the unit is ensured.

An energy cylinder for operating a valve of a turbine, in particular of a steam turbine, is disclosed, wherein a cylinder housing and a control block are combined into a common block. The latter has two diametrically arranged lateral surfaces on which a control valve and a logic valve for controlling the pressure medium flows are arranged.

The invention claimed is:

1. A hydraulic cylinder for operating a valve of a turbine, comprising:

a cylinder housing and a piston guided therein, the piston rod of which is in operative connection with a valve element of said valve, and which is biased with the aid of a spring into a home position, and comprising a control valve through which a pressure chamber of said hydraulic cylinder may be subjected to pressure medium or connected with a tank (T), as well as a quick-action stop valve whereby said pressure chamber may be connected with said tank for rapid pressure reduction, wherein said control valve and said quick-action stop valve are arranged on a control block, wherein said control block and said cylinder housing are combined into a block having at least two approximately diametrically arranged lateral surfaces on which said control valve and said quick-action stop valve, respectively, are attached wherein a passage of said block communicating with a work port (B) of aid control valve is connected with an annular passage encircling a bush wherein said piston rod is guided, into which annular passage a passage leading to an inlet port (A) of said quick-action stop valve and to said chamber opens.

2. The hydraulic cylinder in accordance with claim 1, wherein said block has an approximately parallelepipedic shape.

3. The hydraulic cylinder in accordance with claim 2, wherein a piston axis of said hydraulic cylinder is situated in a plane of symmetry of said two diametrically arranged lateral surfaces.

4. The hydraulic cylinder in accordance with claim 1, wherein it has the form of a double rod cylinder.

5. The hydraulic cylinder in accordance with claim 4, wherein a rear-side piston rod is guided in a bush of said block, and an end portion of said piston rod protruding from said block cooperates with a path measurement system.

6. The hydraulic cylinder in accordance with claim 4, wherein a passage of said block communicating with a work port (B) of said control valve is connected with an annular passage encircling a bush wherein said piston rod is guided, into which annular passage a passage leading to an inlet port (A) of said quick-action stop valve and to said pressure chamber opens.

7. The hydraulic cylinder in accordance with claim 6, wherein a meter-out orifice determining the piston rod velocity is provided in said passage leading to said inlet port (A) of said quick-action stop valve.

8. The hydraulic cylinder in accordance with claim 7, wherein said pressure chamber includes a damping chamber connected with a section of said passage via a damping orifice arranged in parallel with said meter-out orifice.

9. The hydraulic cylinder in accordance with claim 8, wherein said control block is integrated in said cylinder housing.

10. The hydraulic cylinder in accordance with claim 1, wherein a meter-out orifice determining the piston rod velocity is provided in said passage leading to said inlet port (A) of said quick-action stop valve.

11. The hydraulic cylinder in accordance with claim 10, wherein said pressure chamber includes a damping chamber connected with a section of said passage via a damping orifice arranged in parallel with said meter-out orifice.

12. The hydraulic cylinder in accordance with claim 1, wherein at least one of said quick-action stop valve is a piloted logic valve and said control valve is a servo valve.

13. The hydraulic cylinder in accordance with claim 1, wherein said control block is integrated in said cylinder housing.

* * * * *